US008417177B2

(12) United States Patent
Ito et al.

(10) Patent No.: US 8,417,177 B2
(45) Date of Patent: Apr. 9, 2013

(54) IMAGE FORMING APPARATUS HAVING LOWERED IMAGE FORMING POSITION AND RECESSED SHEET STACKING PORTION

(75) Inventors: Sakae Ito, Nishikasugai-gun (JP); Shusaku Tsusaka, Nagoya (JP); Yasuo Tamaru, Nagoya (JP); Tomitake Aratachi, Nagoya (JP); Terumasa Ito, Ama-gun (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 304 days.

(21) Appl. No.: 12/314,373

(22) Filed: Dec. 9, 2008

(65) Prior Publication Data

US 2009/0097894 A1 Apr. 16, 2009

Related U.S. Application Data

(62) Division of application No. 11/090,989, filed on Mar. 28, 2005, now Pat. No. 7,526,226.

(30) Foreign Application Priority Data

Mar. 31, 2004 (JP) ..... 2004-105504

(51) Int. Cl.
*G03G 15/00* (2006.01)

(52) U.S. Cl.
USPC ..... 399/405; 399/107; 399/118

(58) Field of Classification Search ..... 399/107, 399/110, 111, 113, 118, 119, 122, 124, 125, 399/361, 405
See application file for complete search history.

(56) References Cited

U.S. PATENT DOCUMENTS

| | | | |
|---|---|---|---|
| 5,291,256 | A | 3/1994 | Kitajima et al. |
| 5,377,970 | A | 1/1995 | Kikuchi |
| 6,015,148 | A | 1/2000 | Cho |

(Continued)

FOREIGN PATENT DOCUMENTS

| | | |
|---|---|---|
| JP | A 59-045466 | 3/1984 |
| JP | A 59-45466 | 3/1984 |

(Continued)

OTHER PUBLICATIONS

Japanese Office Action with English-language translation thereof dated Nov. 24, 2009 for Japanese Patent Application No. 2007-131614.

(Continued)

*Primary Examiner* — Hoang Ngo
(74) *Attorney, Agent, or Firm* — Oliff & Berridge, PLC

(57) ABSTRACT

In a printer, a scanner unit is formed into a taper shape having a thinner thickness on a side of a pick-up roller in a removing direction of a process unit, to allow the process unit to be removed from the printer. A part of a sheet feeding path is formed in an area between the process unit and a sheet cassette. An image forming position on the sheet feed path is set lower than an upper end of the pick-up roller. Thus, removal of the process unit can be readily performed. Further, the height of the printer at a position of the pick-up roller can be reduced as compared with a case where the scanner unit is not formed into a taper shape.

11 Claims, 3 Drawing Sheets

U.S. PATENT DOCUMENTS

| | | | | |
|---|---|---|---|---|
| 6,078,764 | A | 6/2000 | Akutsu | |
| 6,078,765 | A | 6/2000 | Takano et al. | |
| 6,311,026 | B1 | 10/2001 | Higeta et al. | |
| 6,385,414 | B1 | 5/2002 | Sato et al. | |
| 2002/0131792 | A1 * | 9/2002 | Nomura | 399/118 |
| 2003/0095808 | A1 * | 5/2003 | Takami | 399/71 |
| 2003/0175042 | A1 | 9/2003 | Nishimura | |
| 2003/0215261 | A1 * | 11/2003 | Karakama et al. | 399/111 |
| 2003/0235428 | A1 | 12/2003 | Suzukie et al. | |

FOREIGN PATENT DOCUMENTS

| | | | |
|---|---|---|---|
| JP | A-59-045466 | | 3/1984 |
| JP | U 59-173638 | | 11/1984 |
| JP | U 4-16451 | | 2/1992 |
| JP | A 4-171474 | | 6/1992 |
| JP | A 04-171474 | | 6/1992 |
| JP | A 04-329557 | | 11/1992 |
| JP | A-04-329557 | | 11/1992 |
| JP | A 05-297649 | | 11/1993 |
| JP | A 06-106819 | | 4/1994 |
| JP | A 06-308793 | | 11/1994 |
| JP | A 6-308793 | | 11/1994 |
| JP | A 7-072757 | | 3/1995 |
| JP | A 7-244410 | | 9/1995 |
| JP | A 07-244410 | | 9/1995 |
| JP | A 08-030180 | | 2/1996 |
| JP | A 09-185201 | | 7/1997 |
| JP | A 09-185202 | | 7/1997 |
| JP | A-09-222843 | | 8/1997 |
| JP | A 09-222843 | | 8/1997 |
| JP | A-10-63133 | | 3/1998 |
| JP | A-10-072174 | | 3/1998 |
| JP | A 10-072174 | | 3/1998 |
| JP | A 10-254327 | | 9/1998 |
| JP | 11-146112 | * | 5/1999 |
| JP | A 11-146112 | | 5/1999 |
| JP | A-11-146112 | | 5/1999 |
| JP | A 11-155034 | | 6/1999 |
| JP | A 11-202734 | | 7/1999 |
| JP | A 11-231711 | | 8/1999 |
| JP | A-2000-010439 | | 1/2000 |
| JP | A 2000-089647 | | 3/2000 |
| JP | A 2000-147960 | | 5/2000 |
| JP | A 2000-347472 | | 12/2000 |
| JP | A 2001-001608 | | 1/2001 |
| JP | A-2001-001608 | | 1/2001 |
| JP | A 2001-042586 | | 2/2001 |
| JP | A 2001-100493 | | 4/2001 |
| JP | A 2001-100550 | | 4/2001 |
| JP | A 2001-175123 | | 6/2001 |
| JP | A 2001-282075 | | 10/2001 |
| JP | A 2002-062711 | | 2/2002 |
| JP | A 2002-162865 | | 6/2002 |
| JP | A 2002-182545 | | 6/2002 |
| JP | A 2003-271030 | | 9/2003 |
| JP | A-2004-13038 | | 1/2004 |

OTHER PUBLICATIONS

Sep. 30, 2011 Office Action issued in European application No. 05007065.5.

Office Action issued in European Application No. 05007065.5 dated Apr. 23, 2012.

Search Report issued in European Application No. 05007065.5 dated May 6, 2008.

Mar. 9, 2012 Extended Search Report issued in European Patent Application No. 10008296.5.

Sep. 30, 2011 Office Action issued in European Patent Application No. 05 007 065.5.

* cited by examiner

IMAGE FORMING APPARATUS HAVING LOWERED IMAGE FORMING POSITION AND RECESSED SHEET STACKING PORTION

This is a Divisional of application Ser. No. 11/090,989 filed Mar. 28, 2005. The disclosure of the prior application is hereby incorporated by reference herein in its entirety.

BACKGROUND

1. Field of Invention

The invention relates to an image forming apparatus.

2. Description of Related Art

Known image forming apparatuses form an image by developing with toner an electrostatic latent image formed on a photosensitive member. For example, in an image forming apparatus, as disclosed in Japanese Laid-Open Patent Publication No. 2003-271030, a sheet is fed by a pick-up roller one by one to a sheet feed path from a sheet accommodating portion disposed on a lower part of the image forming apparatus. An image is formed on the sheet while the sheet is being fed in the sheet feed path. After image formation, the sheet is discharged onto a discharge tray provided on an upper part of the image forming apparatus.

The image forming apparatus includes a process unit provided with a photosensitive member and a toner tank, a scanner unit provided with a polygon mirror for forming an electrostatic latent image on the photosensitive member by scanning laser beam, and a fixing unit for thermally fixing a visible toner image transferred on a sheet.

In the vicinity of the pick-up roller, the sheet accommodating portion, the pick-up roller, the process unit, and the scanner unit are disposed in a stacking manner in a height direction of the image forming apparatus.

In the vicinity of the fixing unit, the sheet accommodating portion, the fixing unit, and the discharge tray are disposed in a stacking manner in the direction of the image forming apparatus.

In the image forming apparatus, the process unit is moved substantially horizontally, when removed from the image forming apparatus, while passing through a space between the pick-up roller and the scanner unit. For example, when an amount of toner remaining in the toner tank becomes small, the process unit is replaced to have a sufficient amount of toner in the toner tank.

In the vicinity of the pick-up roller, the sheet accommodating portion, the pick-up roller, the process unit, and the scanner unit are disposed in a stacking manner, so that the image forming apparatus needs to have a height that covers a total height of the sheet accommodating portion, the pick-up roller, the process unit, and the scanner unit. Consequently, the image forming apparatus becomes high and is not downsized.

In the vicinity of the fixing unit, the sheet accommodating portion, the fixing unit, and the discharge tray are disposed in a stacking manner. Accordingly, the image forming apparatus becomes high, similarly as described above.

If the arrangements of the above-described components or units of the image forming apparatus are significantly changed to reduce the height of the image forming apparatus, additional components may be required or installation or removal of the process unit may become difficult.

SUMMARY

Accordingly, one aspect of the invention is to provide an image forming apparatus capable of forming an image by developing an electrostatic latent image formed on a photosensitive member, in which increases in the height of the image forming apparatus is prevented without significantly changing arrangements of a sheet accommodating portion, a pick-up roller, a process unit, and a scanner unit of the image forming apparatus.

In various exemplary embodiments, at least a part of the feed path is substantially parallel to the removal path and located between the sheet accommodating portion and the process cartridge when the process cartridge is installed in the main casing; the scanner unit includes a frame including a first portion having a first height and a second portion having a second height that is less than the first height, the second portion being located closer to the pick-up roller than the first portion; and an image forming position where an image is transferred from the photosensitive member to the sheet is located along the feed path at a position lower than an upper surface of the pick-up roller in a vertical direction.

The image forming apparatus may require a height that covers a total height of the recording medium accommodating portion, the pick-up roller, the process cartridge and the scanner unit. The thickness of components disposed directly above the pick-up roller may mostly affect the height of the image forming apparatus.

Therefore, to reduce the height of the image forming apparatus, the thickness of components disposed directly above the pick-up roller may be reduced as much as possible. Other components of the image forming apparatus may be disposed at an area other than that directly above the pick-up roller, so as to effectively use the space in a height direction of the image forming apparatus. The process cartridge, as one of components of the image forming apparatus, may be structured so as to be removed substantially horizontally while passing above the pick-up roller.

More specifically, the scanner unit of the image forming apparatus may be formed in a taper shape such that a thickness of the scanner unit on a side of the pick-up roller in the removing direction is reduced, to allow the process cartridge to be removed.

Further, a part of the feeding path may be formed in an area between the process cartridge and the recording medium accommodating portion, and the image forming position placed on the feed path may be set lower than an upper end of the pick-up roller.

Therefore, in the image forming apparatus, removal of the process cartridge may be readily performed. Further, the height of the image forming apparatus at a position of the pick-up roller may be reduced as compared with a case where the scanner unit is not formed in a taper shape.

The position of the process cartridge in the image forming apparatus may be lowered by the amount that the image forming position is lowered from the upper end of the pick-up roller. Thus, the height of the image forming apparatus at the image forming position may be reduced.

The process cartridge may preferably include the photosensitive member. Thus, the photosensitive member may be replaced when the process cartridge is replaced.

The process cartridge may preferably include a transfer roller that transfers onto the recording medium a visible image on the photosensitive member. Thus, the transfer roller may be replaced when the process cartridge is replaced. By providing the transfer roller in the process cartridge, the height of the process cartridge may be increased. However, without increasing the overall height of the image forming apparatus, the space for removably setting the process cartridge in the image forming apparatus may be ensured.

In various exemplary embodiments, an image forming apparatus includes: a main casing; a photosensitive member; a process cartridge that can be installed or removed with respect to the main casing along a removal path, the process cartridge including a developer accommodating portion that can accommodate a developer; a scanner unit located above the process cartridge when the process cartridge is installed in the main casing, the scanner unit being capable of irradiating a surface of the photosensitive member with a laser beam; a sheet accommodating portion located at a bottom portion of the main casing, the sheet accommodating portion being capable of accommodating a sheet; a pick-up roller located above the sheet accommodating portion, the pick-up roller being capable of drawing the sheet from the sheet accommodating portion; and a feed path along which the sheet can be conveyed from the sheet accommodating portion to a discharge port.

The scanner unit may include a laser diode that emits a laser beam, a polygonal mirror that reflects the laser beam from the laser diode, a motor that rotates the polygonal mirror, a first mirror that reflects the laser beam from the polygonal mirror, and a second mirror that reflects the laser beam from the first mirror. The first mirror may be positioned adjacent to the front wall. The second mirror, the polygonal mirror and the motor are positioned adjacent to the rear wall.

Thus, the scanner unit may be formed in a taper shape having a thinner thickness on a side of the pick-up roller, so that the height of the image forming apparatus at the position near the pick-up roller may be reduced.

The feed path may be continuously inclined downward from the upper surface of the pick-up roller to the image forming position.

With such a structure, an area above the feed path between the pick-up roller and the image forming position may be effectively used, and in turn, the size of the image forming apparatus may be reduced.

The photosensitive member and the developer accommodating portion will be relatively thick and take larger space, as compared with other components of the image forming apparatus. Therefore, it is preferable that the photosensitive member and the developer accommodating portion be prevented from being disposed directly above a roller for feeding the recording medium, as much as possible. More specifically, the photosensitive member and the developer accommodating portion may be disposed on a side of the image forming position in the removing direction, with respect to a position directly above the pick-up roller. In a case where a register roller is disposed on the feed path between the pick-up roller and the image forming position, the photosensitive member and the developer accommodating portion may be disposed on a side of the image forming position in the removing direction, with respect to a position directly above the register roller.

With such a structure, the photosensitive member and the developer accommodating portion may not overlap with the pick-up roller and or the register roller. Thus, while ensuring the sizes of the photosensitive member and the developer accommodating portion, the image forming apparatus may be reduced in size.

The scanner unit may be formed in a taper shape having a thinner thickness on a side of the pick-up roller. For the image forming apparatus to have a constant thickness even at the tapered portion of the scanner unit, the scanner unit may be disposed on a side of the image forming position in the removing direction, with respect to a position directly above the pick-up roller.

With such a structure, the scanner unit may not overlap with the pick-up roller. Therefore, the height of the image forming apparatus at the position of the pick-up roller may be reduced.

A heat roller that heats the developer transferred onto the recording medium, a discharge roller that discharges the recording medium outside the image forming apparatus through a discharge port and is disposed near the discharge port, and a guide that guides the recording medium at an interval between the heat roller and the discharge roller, may be disposed in the feed path. Preferably, the interval between the heat roller and the discharge roller may be shorter than a length, with respect a feeding direction of the recording medium, of the recording medium of a minimum recordable size.

With such a structure, in the feed path between the heat roller and the discharge roller, other rollers may not have to be disposed, so that spaces for disposing other rollers may be saved, and in turn, the image forming apparatus may be reduced in size.

To reduce the size of the image forming apparatus, the recording medium may be discharged through the discharge port, by curving the recording medium immediately after the passage of the heat roller. However, if the recording medium is curved immediately after the passage of the heat roller, the recording medium may be left curved after the recording medium is discharged through the discharge port. Therefore, the curvature of the guide, which forms the feed path, near the discharge roller may be greater than that near the heat roller.

With such a structure, a position where the discharge roller is disposed may be lowered while effectively preventing the recording medium from being curled.

In the image forming apparatus, the feed path may have such a shape that turns the recording medium near the pick-up roller and at a downstream of the image forming position in a feeding direction of the recording medium. The feed path may be preferably formed into a substantially "S" shape when viewed from an axial direction of the pick-up roller.

With such a structure, a long feed path may be formed relative to the size of the image forming apparatus. Therefore, components of the image forming apparatus that are to be disposed in the vicinity of the feed path may be efficiently arranged.

The image forming apparatus may include a fixing unit including a heat roller that heats the developer, which is transferred onto the recording medium, a discharge port through which the recording medium having the developer fixed thereon by the fixing unit is discharged on an upper portion of the image forming apparatus, and a recording medium stacking portion that stacks, at the upper portion of the image forming apparatus, the recording medium that is discharged from the discharge port through the feed path. In this case, the recording medium stacking portion may be preferably provided with a recess that places a bottom surface of the recording medium stacking portion on a side near the discharge port, lower than an upper face of the fixing unit.

With such a structure, the recess of the recording medium stacking portion may be formed at a position lower than the upper face of the fixing unit. Therefore, the discharge port may be disposed at a relatively lower position without reducing the number of the recording mediums stackable in the recording medium stacking portion. Thus, the height of the image forming apparatus at a position near the discharge port may be reduced.

The fixing unit may include a heating element that is heated by a power application, a switching device that switches off the power application to the heating element at a predetermined temperature and is disposed above the heat roller, and a pressing roller that is pressed toward a rotating axis of the heat roller and is disposed on a side opposite to the pick-up roller with respect to a position directly below the heat roller. In this case, the switching device may be preferably disposed on a plane perpendicular to a line connecting the rotating axis of the heat roller and a rotating axis of the pressing roller.

More specifically, the switching device may sense the heat that the heat roller gives off. Therefore, it is preferable that the switching device be disposed above the heat roller. However, if the switching device is disposed directly above the heat roller or at a downstream side of a position just above the heat roller in the feeding direction of the recording medium (that is, a side opposite to the pick-up roller with respect to a position directly below the heat roller), the position of the recess of the recording medium stacking portion may be disposed at a higher position. Therefore, the switching device may be disposed on a plane perpendicular to a line connecting the rotating axis of the heat roller and a rotating axis of the pressing roller.

With such a structure, the recess of the recording medium stacking portion may be disposed at a lower position. Thus, the height of the image forming apparatus may be reduced.

The fixing unit may include a cover that covers the heat roller and the switching device while exposing the pressing roller. The cover may preferably support the switching device on the plane perpendicular to the line connecting the rotating axis of the heat roller and the rotating axis of the pressing roller.

With such a structure, a cover may not be disposed at the lower part of the fixing unit. Thus, the height of the image forming apparatus may be reduced by the thickness of the cover.

The image forming apparatus may further include a circuit board that electrically controls components of the image forming apparatus and mounts an electronic circuit on the circuit board. The circuit board may preferably be disposed at one side of the image forming apparatus along a vertical plane parallel to the removing direction.

With such a structure, the thickness of the circuit board may not be reflected on the height of the image forming apparatus. Thus, the height of image forming apparatus may be reduced as compared with a case in which the circuit board is arranged substantially horizontally.

In the image forming apparatus, a charger may be provided at the process cartridge. The photosensitive member may have a cylindrical shape extending in a direction perpendicular to the removing direction. The charger may be disposed at a position within about 45 degrees from the removing direction in a radial direction of the photosensitive member.

With such a structure, the charger may not project upward from the upper end of the photosensitive member. Hence, the position of the charger may not be reflected on the height of the image forming apparatus.

The image forming apparatus may further include a sending-out roller that sends out the recording medium accommodated in the recording medium accommodating portion to a position where the pick-up roller is capable of feeding the recording medium, and a separation pad that feeds only the recording medium placed uppermost in the recording medium accommodating portion, when a plurality of recording mediums is fed by the sending-out roller, by contacting the recording mediums. The separation pad may be disposed near a position where the pick-up roller is capable of feeding the recording medium.

By providing the sending-out roller in the image forming apparatus, the load applied to the separation pad by the recording medium may be reduced, so that wear of the separation pad and the recording medium may be prevented.

An image forming apparatus may include a recording medium accommodating portion, provided at a bottom of a main casing, that accommodates a recording medium, a feed path formed between the recording medium accommodating portion and the process cartridge when the process cartridge is attached to the main casing, a fixing unit including a heat roller that heats a developer, which is transferred onto the recording medium, a discharge port through which the recording medium having the developer fixed thereon by the fixing unit is discharged on an upper portion of the image forming apparatus, and a recording medium stacking portion that stacks, at the upper portion of the image forming apparatus, the recording medium that is discharged from the discharge port through the feed path. The recording medium stacking portion may be provided with a recess that places a bottom surface of the recording medium stacking portion on a side near the discharge port, lower than an upper face of the fixing unit.

With such a structure, the recess of the recording medium stacking portion may be formed at a position lower than the upper face of the fixing unit. Therefore, the discharge port may be disposed at a relatively lower position without reducing the number of the recording mediums stackable in the recording medium stacking portion. Thus, the height of the image forming apparatus at a position near the discharge port may be reduced.

A heat roller that heats the developer transferred onto the recording medium, a discharge roller that discharges the recording medium outside the image forming apparatus through a discharge port and is disposed near the discharge port, and a guide that guides the recording medium at an interval between the heat roller and the discharge roller may be disposed in the feed path. Preferably, the interval between the heat roller and the discharge roller may be shorter than a length, with respect a feeding direction of the recording medium, of the recording medium of a minimum recordable size.

With such a structure, in the feed path between the heat roller and the discharge roller other rollers may not have to be disposed, so that spaces for disposing other rollers may be saved, and in turn, the image forming apparatus may be reduced in size.

The guide forming the feed path may have a curvature for curving the recording medium that has passed the heat roller. Preferably, the curvature of the guide near the discharge roller may be greater than that near the heat roller.

With such a structure, a position where the discharge roller is disposed may be lowered while effectively preventing the recording medium from being curled.

The fixing unit may include a heating element that is heated by a power application, a switching device that switches off the power application to the heating element at a predetermined temperature and is disposed above the heat roller, and a pressing roller that is pressed toward a rotating axis of the heat roller and is disposed on a side opposite to the pick-up roller with respect to a position directly below the heat roller. The switching device may preferably be disposed on a plane perpendicular to a line connecting the rotating axis of the heat roller and a rotating axis of the pressing roller.

With such a structure, the recess of the recording medium stacking portion may be disposed at a lower position. Thus, the height of the image forming apparatus may be reduced.

The fixing unit may include a cover that covers the heat roller and the switching device while exposing the pressing roller. The cover may support the switching device on the plane perpendicular to the line connecting the rotating axis of the heat roller and the rotating axis of the pressing roller.

With such a structure, a cover may not be disposed at the lower part of the fixing unit. Thus, the height of the image forming apparatus may be reduced by the thickness of the cover.

BRIEF DESCRIPTION OF THE DRAWINGS

An embodiment of the invention will be described in detail with reference to the following figures wherein.

DETAILED DESCRIPTION OF EMBODIMENT

Figure 1:
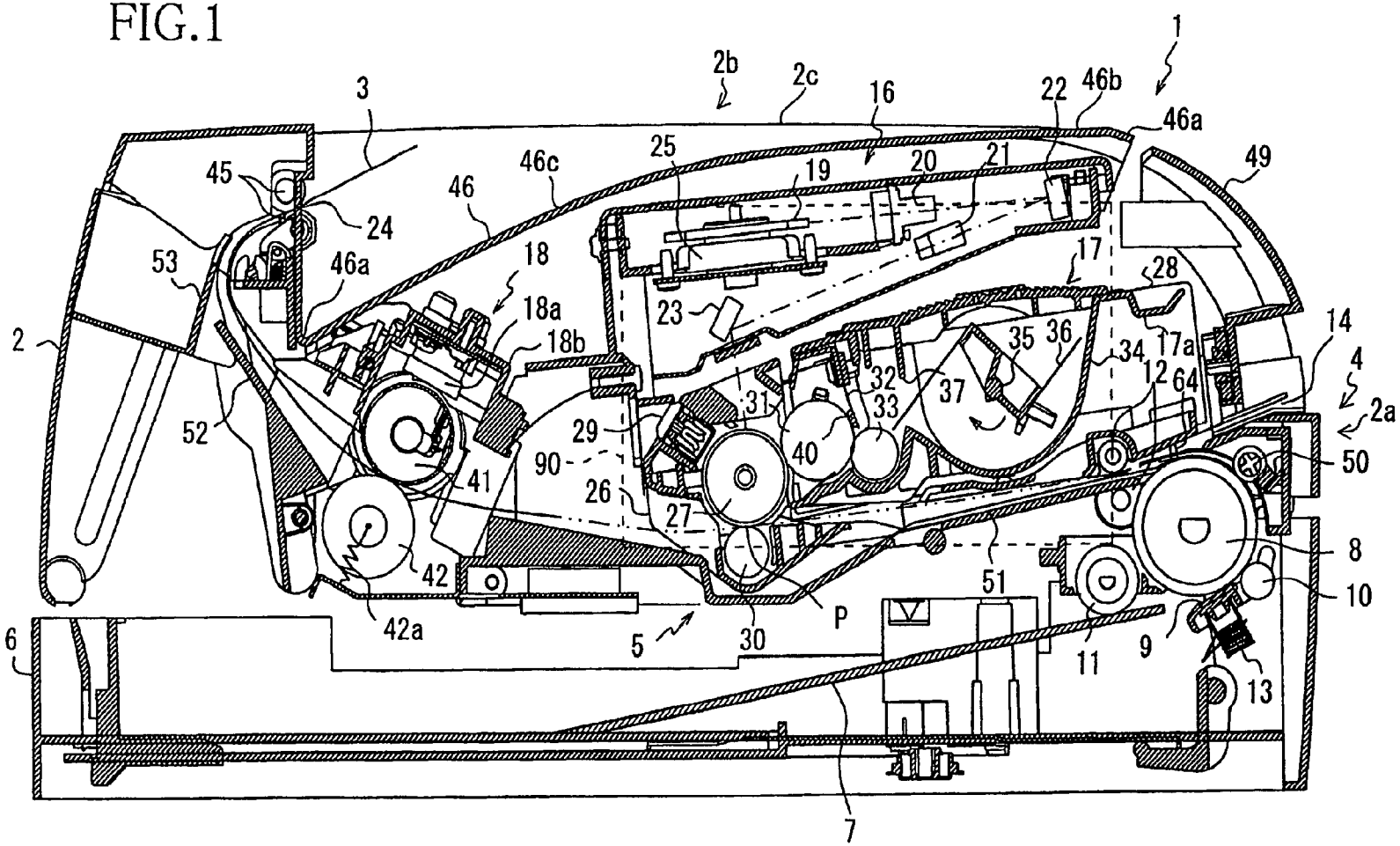
FIG. 1 is a side cross sectional view of an essential portion of a printer as an image forming apparatus according to an embodiment of the invention.

An embodiment of the invention will be described with reference to the accompanying drawings. FIG. 1 shows a side cross sectional view of a printer 1 viewed from an axial direction of rollers of the printer 1. The right side in FIG. 1 is defined as a front side and the left side is defined as a rear side. A front cover 49 is disposed on a front side face (front face) 2*a* of the printer 1.

As shown in FIG. 1, the printer 1 is provided in a main casing 2 with a feeder portion 4 for feeding a paper sheet 3 (recording medium) and an image forming portion 5 for forming an image on the fed sheet 3. Disposed in an upper portion of the printer 1 is a discharge tray 46 that is used to hold the discharged sheet 3 having an image formed thereon by the printer 1.

The feeder portion 4 has a sheet cassette 6, a sheet mount plate 7 arranged within the sheet cassette 6, a sending-out roller 11 arranged above one end portion of the sheet cassette 6, a pick-up roller 8, a separation pad 9, a pinch roller 10 opposing the pick-up roller 8, a sheet powder removing roller 50, and register rollers 12 arranged downstream of the sheet powder removing roller 50 in a sheet feeding direction.

The sheet cassette 6 is removably set on a bottom of the main casing 2 and is used to accommodate a stack of the sheets 3 in the sheet cassette 6. The sheet cassette 6 is pulled out toward the front side of the printer 1 (right side in FIG. 1) when the sheets 3 are added to the sheet cassette 6. As the sheet cassette 6 is pulled out, the feeder portion 4 is divided at a position between the pick-up roller 8 and the separation pad 9, so that the pinch roller 10, the separation pad 9 and a spring 13 arranged on a back side of the separation pad 9 are pulled out together with the sheet cassette 6.

The sheet mount plate 7 is pivotally supported on an end far from the pick-up roller 8, so that the other end of the sheet mount plate 7 near the pick-up roller 8 can be moved in a vertical direction. The sheet mount plate 7 is urged upwardly by a spring (not shown). As the amount of the sheets 3 stacked on the sheet mount plate 7 increases, the sheet mount plate 7 pivots downward about the one end far from the pick-up roller 8 against an urging force of the spring.

The sending-out roller 11 is disposed so as to contact the uppermost sheet 3 stacked on the sheet mount plate 7 in the sheet cassette 6. The sending-out roller 11 feeds the sheet 3 to a position where the pick-up roller 8 can feed the sheet 3, that is, to a position between the pick-up roller 8 and the separation pad 9.

The separation pad 9 is arranged in confrontation with the pick-up roller 8. The separation pad 9 is pressed toward the pick-up roller 8 by the spring 13 arranged on the back side of the separation pad 9. The separation pad 9 has a function for preventing plural sheets 3 from being supplied in an overlapping state into a sheet feed path (shown by the two-dotted chain line in FIG. 1). More specifically, the sheet 3 sent by the sending-out roller 11 comes into contact with the pick-up roller 8 and the separation pad 9. At this time, some frictional force is applied between the separation pad 9 and the sheet 3. Accordingly, even when the plural sheets 3 are sent by the sending-out roller 11 to the separation pad 9, the sheets 3 other than the uppermost sheet 3 are stopped by the separation pad 9. Therefore, the sheet 3 is supplied one at a time from the pick-up roller 8.

The sheet 3 fed by the pick-up roller 8 is sent to the sheet feed path. At this time, sheet powder or fibers are removed from the sheet 3 by the sheet powder removing roller 50. Then, the sheet 3 is fed to the register rollers 12. The sheet feed path is formed downward, with respect to the horizontal direction, at the entire interval from the upper end of the pick-up roller 8 to an image forming position P. Most part of the sheet feed path between the pick-up roller 8 and the image forming position P is formed by a guide member 51 provided on the main casing 2 and by a bottom of a process unit 17.

The pick-up roller 8 sends the sheet 3 to the register rollers 12 by turning the sheet 3 about 180 degrees. When curvature for curving or turning the sheet 3 by the pick-up roller 8 is large and the sheet 3 is of thick material, such as a postcard, the sheet 3 may possibly be bent or may not be conveyed up to the register rollers 12 due to the resistance applied when the sheet 3 is bent.

Accordingly, the diameter of the pick-up roller 8 is set larger than rollers, such as a photosensitive drum 27 and a heat roller 41. More specifically, the diameter of the pick-up roller 8 is set to about 33 mm in the embodiment when the diameter of the photosensitive drum 27 is set to about 24 mm and the diameter of the heat roller 41 is set to about 25 mm. As the diameter of the pick-up roller 8 is set relatively large and the curvature for curving the sheet 3 is set small, the sheet 3 can be preferably conveyed by the pick-up roller 8 without bending the sheet 3.

The register rollers 12 are made up of a pair of rollers. Driving and stopping the register rollers 12 are controlled by a controller (not shown) arranged within a circuit board 90 (described below), based on timing of detection by a position sensor 64, which is arranged near the pick-up roller 8. Under such control, skew of the sheet 3 is corrected by the register rollers 12. More specifically, the controller sets the register rollers 12 to a driving state during sheet feeding by the pick-up roller 8, and stops the register rollers 12 when the position sensor 64 detects the leading edge of the sheet 3. Then, as the sheet 3 comes in contact with the register rollers 12 and slacks, the controller again drives the register rollers 12 and sends the sheet 3 to the image forming portion 5.

The position sensor 64 is of a mechanical type. When the position sensor 64 comes in contact with the sheet 3 and is pushed by the sheet 3, the position sensor 64 is moved from a predetermined position.

A manual feed slot 14 for directly feeding the sheet 3 from the front side of the printer 1 to the register rollers 12 is formed above the pick-up roller 8. The sheet 3 can be supplied to the sheet feed path without storing the sheet 3 in the sheet cassette 6.

The image forming portion 5 includes a scanner unit 16, the process unit 17, and a fixing unit 18. The scanner unit 16 is arranged in an upper portion of the main casing 2. The scanner unit 16 has a laser light emitting portion (not shown), a polygon mirror 19 driven by a polygon motor 25 so as to rotate, lenses 20, 21, and reflecting mirrors 22, 23. As shown by the one-dotted chain line in FIG. 1, a laser beam emitted from the laser emitting portion based on image data, passes through or reflects off the polygon mirror 19, the lens 20, the reflecting mirror 22, the lens 21 and the reflecting mirror 23 in this order to irradiate with the laser beam a surface of the photosensitive drum 27 of the process cartridge 17 at high speed.

More specifically, the polygon mirror 19 is arranged over the photosensitive drum 27 and the image forming position P. In the scanner unit 16, the laser beam reflected off the polygon mirror 19 is advanced toward the reflecting mirror 22 substantially in the horizontal direction. Then, the laser beam is reflected off the reflecting mirror 22 toward the reflecting mirror 23 located below the polygon mirror 19. More specifically, the reflecting mirror 22 reflects the incident laser beam at an acute angle, so as to direct the incident laser beam downward by about 15 degrees, with respect to the horizontal direction. The scanner unit 16 including the polygon mirror 19, the lenses 20, 21, and the reflecting mirrors 22, 23 is set to such a size and shape that do not interfere with the optical path of the laser beam. More specifically, an upper face (upper plate) of the scanner unit 16 is arranged substantially horizontally. To be more specific, the upper face of the scanner unit 16 is inclined such that a portion far from the pick-up roller 8 becomes lower. A lower face (lower plate) of the scanner unit 16 is greatly inclined in comparison with the upper face, such that a portion far from the pick-up roller 8 becomes lower. Thus, the scanner unit 16 is formed into a taper shape, such that the image forming position P side to which the polygon mirror 19 is located is thick and the pick-up roller 8 side is thin.

The process unit 17 functioning as an imaging unit is arranged below the scanner unit 16. When the process unit 17 is detachably installed in the main casing 2, the process unit 17 is moved substantially in the horizontal direction and the forward and backward directions (left and right directions in FIG. 1: attaching and detaching directions). The process unit 17 includes a drum cartridge 26 and a developing cartridge 28. A space is defined between the process unit 17 and the scanner unit 16, when the process unit 17 is installed in the main casing 2.

The drum cartridge 26 of the process unit 17 includes the photosensitive drum 27, a scorotron charger 29 and a transfer roller 30.

The developing cartridge 28 includes a developing roller 31, a layer thickness regulating plate 32, a toner supply roller 33, and a toner box 34. The developing cartridge 28 is detachably set in the drum cartridge 26.

The photosensitive drum 27 and the toner box 34 require large spaces relative to other components of the process unit 17. Therefore, the photosensitive drum 27 and the toner box 34 are not disposed directly above the pick-up roller 8 and the register rollers 12 that require comparatively large spaces in the vicinity of the process unit 17.

The toner box 34 is filled with toner (developing agent). The toner within the toner box 34 is agitated by rotating an agitator 36, which is supported by a rotating shaft 35 arranged at a substantially central portion of the toner box 34, in the clockwise direction, as indicated by the arrow in FIG. 1. The agitated toner is discharged from a toner supply port 37 formed in the toner box 34.

The toner supply roller 33 is arranged to the side of the toner supply port 37, so as to rotate in the counterclockwise direction. The developing roller 31 is disposed in confrontation with the toner supply roller 33, so as to rotate in the counterclockwise direction. The toner supply roller 33 and the developing roller 31 contact each other so as to apply some pressures to each other.

The toner supply roller 33 includes a metal roller shaft covered by a roller portion formed of conductive foam. The developing roller 31 includes a metal roller shaft covered by a roller portion formed of a conductive rubber material having no magnetic characteristics. More specifically, the roller portion of the developing roller 31 is formed of conductive urethane rubber or silicone rubber including fine carbon particles. A surface of the roller portion of the developing roller 31 is coated with urethane rubber or silicone rubber including fluorine. A developing bias is applied to the developing roller 31.

The layer thickness regulating blade 32 is arranged in the vicinity of the developing roller 31. The layer thickness regulating blade 32 includes a blade body formed of metal plate spring and a pressing portion 40 disposed at an end of the blade body and formed of insulating silicone rubber into a substantially semicircular shape in cross section. The layer thickness regulating blade 32 is supported by the developing cartridge 28 near the developing roller 31. The pressing portion 40 presses the surface of the developing roller 31 with the elasticity of the blade body.

The toner discharged from the toner supply port 37 is supplied to the developing roller 31 by the rotation of the toner supply roller 33. At this time, the toner is positively frictionally charged between the toner supply roller 33 and the developing roller 31. The toner supplied onto the developing roller 31 enters between the pressing portion 40 of the layer thickness regulating blade 32 and the developing roller 31, as the developing roller 31 is rotated. The toner is further sufficiently frictionally charged and is carried onto the developing roller 31 as a thin layer having a constant thickness.

The photosensitive drum 27 is arranged to the side of the developing roller 31 in confrontation with the developing roller 31, so as to rotate in the clockwise direction. A drum body of the photosensitive drum 27 is grounded and its surface is formed of a positively chargeable photosensitive layer including polycarbonate. The photosensitive drum 27 is rotated by a drive force from a main motor (not shown).

The scorotron charger 29 is disposed with a predetermined distance between the scorotron charger 29 and the photosensitive drum 27, to prevent the charger 29 from contacting the photosensitive drum 27. The scorotron charger 29 is arranged about 30 degrees in an upward radial direction of the photosensitive drum 27, with respect to the horizontal direction. The charger 29 is a positively charging scorotron charger that generates corona discharge from a tungsten wire. The scorotron charger 29 uniformly and positively charges the surface of the photosensitive drum 27.

The surface of the photosensitive drum 27 is first charged uniformly and positively by the scorotron charger 29 while the photosensitive drum 27 is rotated. Thereafter, the surface of the photosensitive drum 27 is selectively exposed to the laser beam emitted from the scanner unit 16 to scan across the surface of the drum 27 at high speed. Thus, an electrostatic latent image, based on predetermined image data, is formed on the surface of the photosensitive drum 27.

Thereafter, as the toner, which is carried on the developing roller 31 and is positively charged, is brought into confrontation with the photosensitive drum 27 in accordance with the rotation of the developing roller 31, the toner is supplied to the electrostatic latent image on the surface of the photosensitive drum 27, that is, parts of the photosensitive drum 27 selectively exposed to the laser beam where the potential level is lower than the remaining part of the photosensitive drum 27 surface uniformly positively charged. Thus, the electrostatic latent image on the photosensitive drum 27 is made visible, to complete a reverse image developing.

The transfer roller 30 is arranged below the photosensitive drum 27 so as to face the photosensitive drum 27. The transfer roller 30 is rotatably supported by the drum cartridge 26 in the counterclockwise direction. The transfer roller 30 includes a metal roller shaft covered by a roller portion formed of an ionic conductive rubber material. A transfer bias (transfer forward bias) is applied to the transfer roller 30 during transfer of the toner onto the sheet 3. The visible toner image carried onto the surface of the photosensitive drum 27 is transferred onto the sheet 3 while the sheet 3 passes the image forming position P between the photosensitive drum 27 and the transfer roller 30.

The fixing unit 18 is arranged downstream of the process unit 17 in the sheet feeding direction behind the process unit 17. The fixing unit 18 includes the heat roller 41 formed with a gear, a pressing roller 42 that presses the heat roller 41, and a thermostat 18*a*. The heat roller 41 and the thermostat 18*a* are covered with a cover 18*b*.

The heat roller 41 is formed of metal and is provided with a halogen lamp as a heat source. The pressing roller 42 has a spring 42*a* that rotatably presses or urges the pressing roller 42 from below toward a rotating axis of the heat roller 41. The pressing roller 42 makes close contact with the heat roller 41 or the sheet 3 and rotates in synchronization with the heat roller 41.

The thermostat 18*a* is, for example, a bimetal thermostat. The thermostat 18*a* turns a power source of a heater for heating the heat roller 41 on or off, in accordance with the heat generated from the heat roller 41, to prevent the heat roller 41 from being heated to an extraordinarily high temperature.

The thermostat 18*a* is arranged above the heat roller 41 on an extension line (virtual line) connecting a rotating axis (not shown) of the pressing roller 42 and a rotating axis (not shown) of the heat roller 41. Therefore, the position of a deepest portion 46*a* of the discharge tray 46 can be disposed lower, in comparison with cases where the thermostat 18*a* is arranged just above the heat roller 41 or on the rear side with respect to the position just above the heat roller 41 toward the downstream side in the sheet feeding direction (left side in FIG. 1).

The cover 18*b* has a shape that covers the side and the upper portion of the heat roller 41, to prevent heat generated by the heat roller 41 in the fixing unit 18 from being discharged out of the unit 18 and adversely affecting other units or devices, such as the scanner unit 16, disposed within the main casing 2. The cover 18*b* supports the rotating axis of the pressing roller 42 so as to rotate, as well as to move toward an urging direction of the spring 42*a*. A lower half of the pressing roller 42 is exposed from the cover 18*b*. Therefore, as compared with a case where the cover 18*b* covers the lower portion of the pressing roller 42 as well, the height of the printer 1 can be reduced by the thickness of the cover 18*b*.

In the fixing unit 18, the heat roller 41 fixes the toner transferred onto the sheet 3 in the process unit 17, while the sheet 3 passes between the heat roller 41 and the pressing roller 42, by the applications of heat and pressures. Further, the heat roller 41 feeds the sheet 3 having an image fixed thereon to discharge rollers 45, through a discharge path formed by guide members 52, 53. The discharge rollers 45 discharge the sheet 3 onto the discharge tray 46. A pair of discharge rollers 45 is disposed near a discharge port 24 for discharging the sheet 3 out of the printer 1.

If the sheet 3 subjected to heat application by the heat roller 41 is suddenly or steeply curved, the curved sheet 3 may not return to the original state. Therefore, the guide members 52, 53 to which the sheet 3 contacts after the passage of the heat roller 41, are formed such that the sheet 3 is gently curved in a heat applied condition soon after the passage of the heat roller 41 and is more greatly curved as the sheet 3 approaches the discharge rollers 45.

With such a structure, the position of the discharge port 24 can be placed lower, as compared with a case where the entire discharge path of the sheet 3 is gently curved. Accordingly, the height of the printer 1 can be readily reduced while permanent curving of the sheet 3 is prevented.

The discharge tray 46 has a gradually downward slope from the front side of the printer 1 to the rear side (left side in FIG. 1). The deepest portion 46*a* of the discharge tray 46 is set lower than the upper end of the fixing unit 18. Therefore, the discharge rollers 45 can be disposed at relatively lower positions without reducing the number of the sheets 3 stackable in the discharge tray 46. Thus, the height of the printer 1 at a position where the scanner unit 16 is disposed and the height of the printer 1 at a position where the discharge rollers 45 are disposed, can be brought closer to each other. Therefore, the printer 1 can have a good design and an appearance.

More specifically, a top cover 2*c* having the discharge tray 46 is arranged on a top face 2*b* of the printer 1. The discharge tray 46 has a curved portion 46*c* curved upward toward the front side, a flat portion 46*b* connected to a front end portion of the curved portion 46*c*, and a round portion 46*a* connected to a front end portion of the flat portion 46*b*.

As shown by the broken line in FIG. 1, arranged on each side face of the sheet feed path is the circuit board 90 mounting thereon the controller for performing controls for driving components of the printer 1, such as the rollers and the polygon mirror 19.

Figure 2:
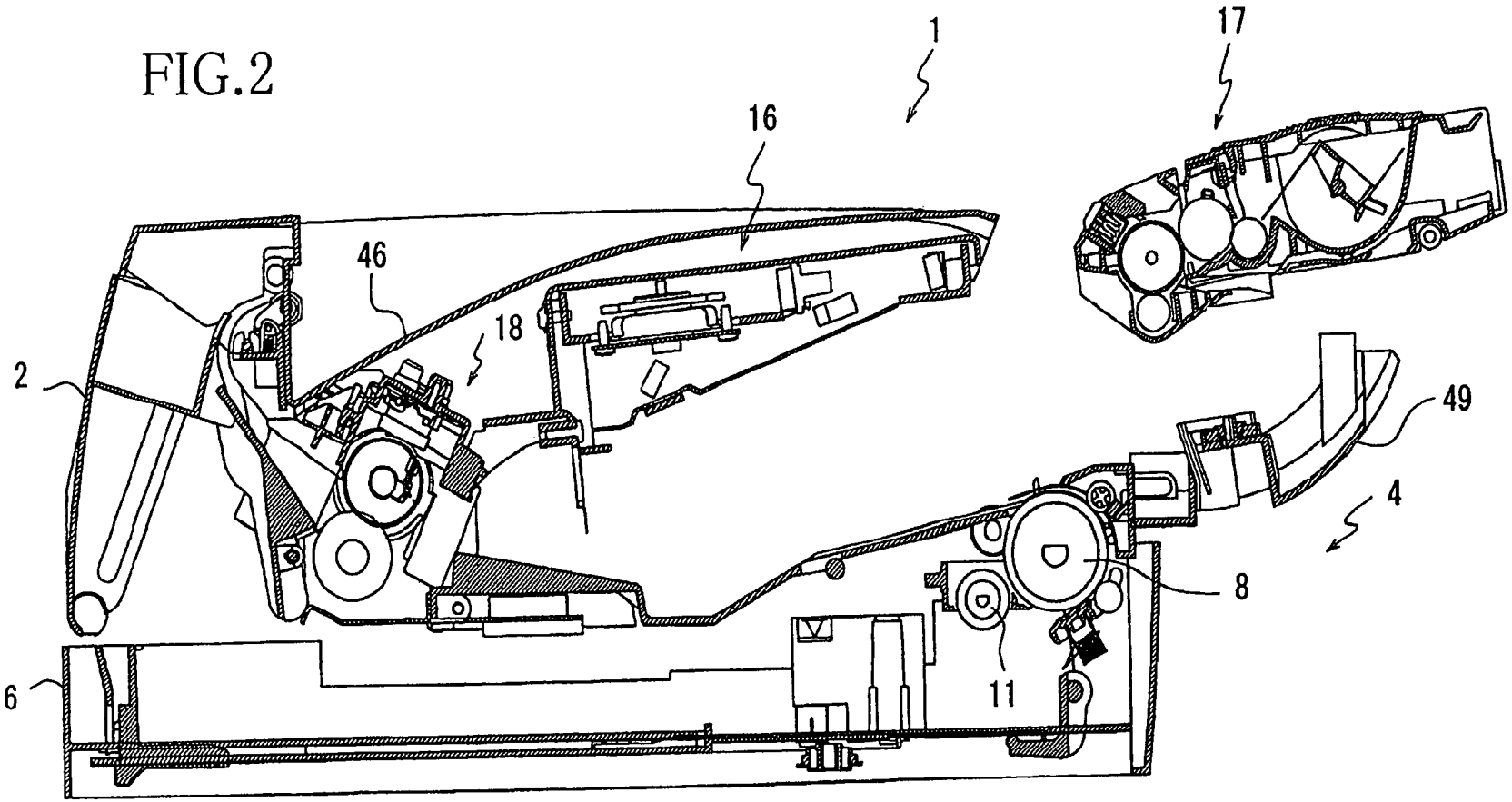
FIG. 2 is a side cross sectional view of the printer illustrating a process unit is removed from the printer.

The removal of the process unit 17 performed by a user will be described with reference to FIGS. 2 and 3. When the process unit 17 is removed from the printer 1 in the state shown in FIG. 1, the user first opens the front cover 49 of the printer 1 toward the front side thereof, as shown in FIG. 2. At this time, the front cover 49 pivots about a support shaft 49*z* as a pivot. The support shaft 49*z* is located above the sheet cassette 6.

With the front cover 49 open, the process unit 17 in the state of FIG. 1 is pulled out toward the front side of the printer 1 (removing direction) substantially in the horizontal direction. The process unit 17 is removed from the printer 1 while passing over the pick-up roller 8. As described above, the space is formed between the process unit 17 and the scanner unit 16 when the process unit 17 is mounted on the printer 1. Therefore, the process unit 17 can be pulled out from the main casing 2, while the user raises a handle 17*a* (shown in FIG. 1) located on the front side of the process unit 17 (side near the pick-up roller 8) toward the scanner unit 16. With such a structure, the rear side of the process unit 17 (image forming position P side) is not likely to be caught in the printer 1. Thus, the process unit 17 can be smoothly pulled out from the printer 1.

Figure 3:
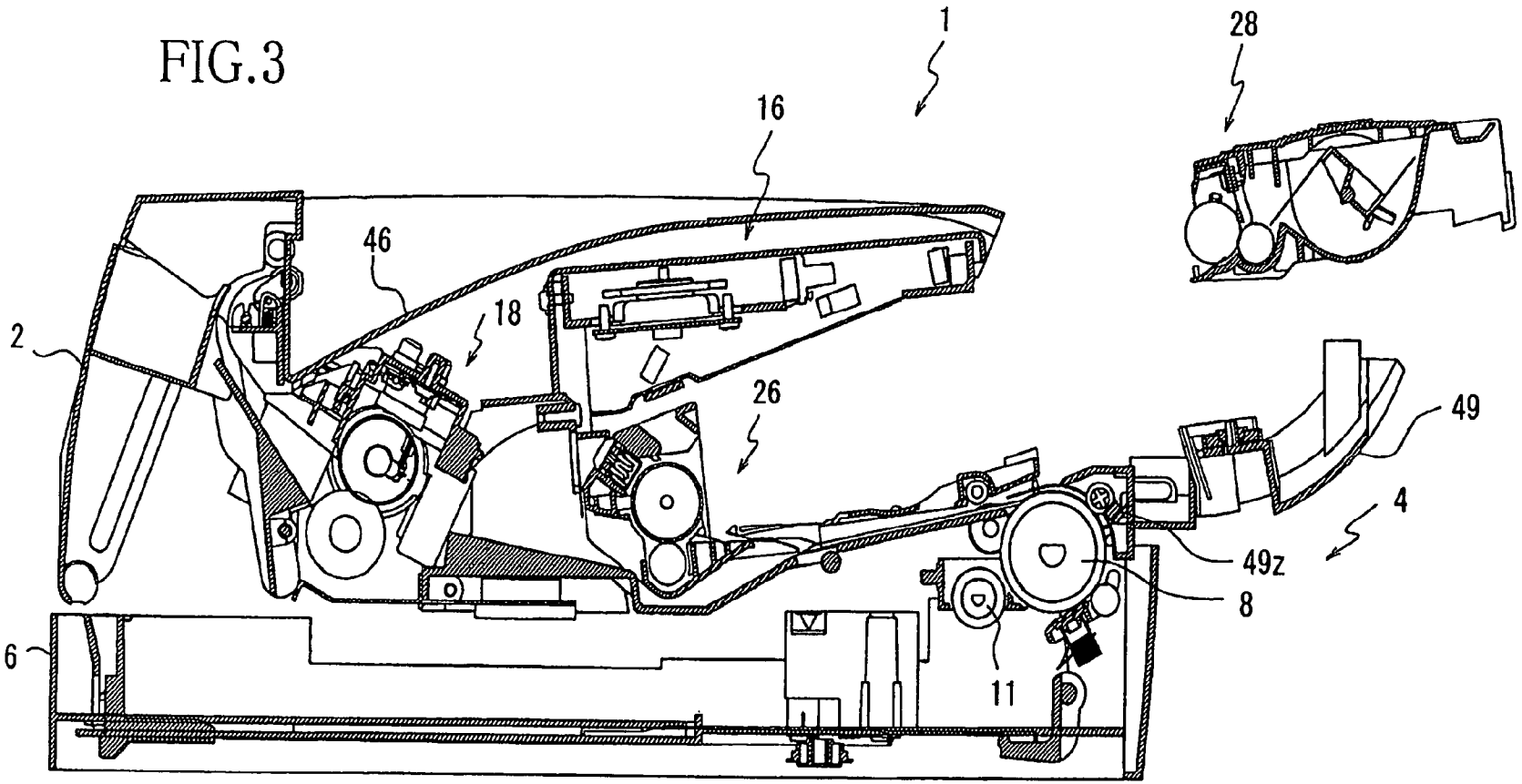
FIG. 3 is a side cross sectional view of the printer illustrating only a developing cartridge of the process unit is removed from the printer.

As shown in FIG. 3, only the developing cartridge 28 can be detached from the printer 1, while the drum cartridge 26 of the process unit 17 is left inside the printer 1.

The above-described printer 1 includes the sheet cassette 6, the sheet feed path, the pick-up roller 8, the process unit 17, and the scanner unit 16. The sheet cassette 6 is capable of storing a stack of the sheets 3 at a lower portion of the printer 1. Provided above the sheet cassette 6 is the sheet feed path along which the sheet 3 stored in the sheet cassette 6 is fed outside the printer 1, via the image forming position P. The pick-up roller 8, which is located above one end portion of the sheet cassette 6, feeds the uppermost sheet 3 in the sheet cassette 6 to the sheet feed path. The process unit 17 disposed near the pick-up roller 8 above the sheet cassette 6 includes the photosensitive drum 27 and the toner box 34 capable of containing the toner. When the process unit 17 is taken out of the printer 1, the process unit 17 can be moved toward the removing direction in substantially horizontal direction while passing over the pick-up roller 8. The scanner unit 16 is arranged above the process unit 17 and has at least the polygon mirror 19.

The scanner unit 16 is formed into a taper shape having a thinner thickness on the pick-up roller 8 side in the removing direction, to allow the process unit 17 to be removed from the main casing 2. A part of the sheet feed path is formed in an area defined by the process unit 17 and the sheet cassette 6. The image forming position P located on the sheet feed path is disposed lower than the upper end of the pick-up roller 8.

With such a structure, the process unit 17 can be easily taken out of the printer 1. Further, since the scanner unit 16 is formed in the taper shape having a thinner thickness in the area above the pick-up roller 8, the height of the printer 1 at the position of the pick-up roller 8 can be reduced in comparison with a case where the scanner unit 16 is not formed in the taper shape.

The position of the process unit 17 in the printer 1 can be lowered by the amount that the image forming position P is lowered from the upper end of the pick-up roller 8. Thus, the height of the printer 1 at the image forming position P can be reduced.

As the process unit 17 has the photosensitive drum 27 and the transfer roller 30, the photosensitive drum 27 and the transfer roller 30 can be replaced when the process unit 17 is replaced.

The scanner unit 16 has the upper and lower plates forming an external wall. The lower plate is more inclined than the upper plate with respect to the horizontal direction. Thus, the height of the printer 1 in the vicinity of the pick-up roller 8 can be reduced.

The scanner unit 16 includes the polygon motor 25 for rotating the polygon mirror 19, and the reflecting mirrors 22, 23 for sequentially reflecting the laser beam scanned by the polygon mirror 19 to guide the laser beam to the photosensitive drum 27. The reflecting mirror 22 for first reflecting the laser beam is located in the scanner unit 16 at a position near the front cover 49 in the removing direction of the process unit 17. The polygon mirror 19, the polygon motor 25 and the reflecting mirror 23 for subsequently reflecting the laser beam are located in the scanner unit 16 at a position away from the front cover 49 in the removing direction of the process unit 17.

Accordingly, the height of the printer 1 in the vicinity of the pick-up roller 8 can be reduced since the scanner unit 16 is formed in the taper shape having a thinner thickness on the pick-up roller 8 side. Further, since the sheet feed path is inclined downward continuously at the entire interval from the upper end of the pick-up roller 8 to the image forming position P, an area above the sheet feed path between the pick-up roller 8 and the image forming position P can be effectively used, and in turn, the size of the printer 1 can be reduced.

The photosensitive drum 27 and the toner box 34 of the process unit 17 are arranged in the area above the pick-up roller 8 on the image forming position P side with respect to the register rollers 12 in the removing direction. The photosensitive drum 27 and the toner box 34 are disposed so as not to overlap with the pick-up roller 8 or the register rollers 12. Accordingly, while ensuring the photosensitive drum 27 and the toner box 34 enough sizes, the printer 1 can be downsized without reducing the sizes of the photosensitive drum 27 and the toner box 34.

In addition, the scanner unit 16 is arranged on a side away from the front cover 49 in the removing direction of the process unit 17. Because the scanner unit 16 is disposed so as not to overlap with the pick-up roller 8, the height of the printer 1 at the position of the pick-up roller 8, can be reduced.

Disposed in the sheet feed path are the heat roller 41 for fixing the toner transferred to the sheet 3, the discharge rollers 45 arranged near the discharge port 24 for discharging the sheet 3 outside the printer 1 between the heat roller 41 and the discharge port 24, and the guide members 52, 53 for guiding the sheet 3 between the heat roller 41 and the discharge rollers 45. The interval from the heat roller 41 to the discharge rollers 45 is set shorter than the length of the minimum recordable sheet size with respect to the sheet feeding direction.

Since the printer 1 has no rollers between the heat roller 41 and the discharge rollers 45, spaces for disposing rollers can be saved, and in turn, the size of the printer 1 can be reduced.

The guide members 52, 53 forming the sheet feed path are set such that the curvature of the guide member 53 at the vicinity of the discharge rollers 45 is greater than that of the guide member 52 at the vicinity of the heat roller 41. Accordingly, positions of the discharge rollers 45 can be lowered, while the sheet 3 is prevented from being curled.

The sheet feed path is formed into a substantially "S" shape when viewed from the axial direction of the pick-up roller 8, so as to turn the sheet 3 at the downstream of the image forming position P in the sheet feeding direction and at the vicinity of the pick-up roller 8.

With such a structure, a long sheet feed path can be formed relative to the size of the printer 1. Thus, components of the printer 1 that are to be disposed in the vicinity of the sheet feed path can be efficiently arranged.

The discharge tray 46 is provided with the deepest portion **46*a* that places a bottom surface of the discharge tray 46 on the discharge port 24 side lower than the upper face of the fixing unit 18. Thus, the area near the heat roller 41 can be effectively used and the position of the discharge port 24 can be lowered. Consequently, the height of the printer 1 in the vicinity of the discharge port 24** can be reduced.

The pressing roller 42 is shifted from the heat roller 41 toward the sheet feeding direction. More specifically, the pressing roller 42 is disposed at a position shifted toward the side opposite to the pick-up roller 8, from a position just below the heat roller 41. The thermostat **18*a* is disposed on a plane perpendicular to a virtual straight line connecting the rotating axes of the heat roller 41 and the pressing roller 42**.

With such a structure, the height of the printer 1 can be further reduced since the position of the deepest portion **46*a* of the discharge tray 46** can be lowered.

Further, since the fixing unit 18 is arranged along the curve of the discharge tray 46, a space within the printer 1 can be effectively used.

The cover **18*b* covers the thermostat 18*a* and the heat roller 41 of the fixing unit 18, while exposing the pressing roller 42**.

With such a structure, the cover **18*b* is not provided for a lower portion of the fixing unit 18. Thus, the height of the printer 1 can be reduced by the thickness of the cover 18*b***.

Further, the circuit board 90 including electronic circuits for electrically controlling the units or components of the printer 1 is disposed in the printer 1 on a vertical plane parallel to the removing direction of the process unit 17 (on the front and rear sides of the sheet feed path when viewed from the axial direction of the pick-up roller 8). Accordingly, the thickness of the circuit board 90 is not reflected on the height of the printer 1. Thus, the height of the printer 1 can be reduced as compared with a case in which the circuit board 90 is arranged substantially horizontally.

Further, since the scorotron charger 29 for charging the photosensitive drum 27 is arranged so as to charge the photosensitive drum 27 at a position within approximately 45 degrees from the horizontal direction in the radial direction of the photosensitive drum 27. Accordingly, the scorotron charger 29 is not likely to project upward from the upper end of the photosensitive drum 27. Hence, the position of the scorotron charger 29 is not likely to be reflected on the height of the printer 1.

The printer 1 has the sending-out roller 11 that conveys the sheet 3 stacked on the sheet cassette 6 to a position where the pick-up roller 8 can feed the sheet 3, and the separation pad 9 that is arranged near a position where the pick-up roller 8 can feed the sheet 3, and feeds the uppermost sheet 3 in the sheet cassette 6, when plural sheets 3 are supplied by the sending-out roller 11, by contacting the sheets 3.

With such a structure, the load applied to the separation pad 9 can be reduced by providing the sending-out roller 11 in the printer 1, so that wear of the separation pad 9 and the sheet 3 can be prevented.

While the embodiment of the invention is described in detail, those skilled in the art will recognize that there are many possible modifications and variations which may be made in the embodiment.

For example, in the above-described embodiment, the printer 1 forms an image on the sheet 3. However, an image may be formed on an OHP sheet or cloth.

Although the thermostat 18*a* is used to prevent the heat roller 41 from being extraordinary heated in the above-described embodiment, a temperature sensor may be used instead of the thermostat 18*a*.

What is claimed is:

1. An image forming apparatus comprising:

a main casing;

a photosensitive member;

a process cartridge being installable to and removable from the main casing along a removal path, the process cartridge including a developer accommodating portion that can accommodate a developer;

an exposing unit located above the process cartridge when the process cartridge is installed in the main casing, the exposing unit including a motor capable of rotating a polygonal mirror and being capable of exposing a surface of the photosensitive member with a light;

a sheet-accommodating portion located at a bottom portion of the main casing, the sheet-accommodating portion being capable of accommodating a sheet;

a pick-up roller located above the sheet-accommodating portion, the pick-up roller being capable of picking up the sheet from the sheet-accommodating portion;

an image transferring position where an image is transferred from the photosensitive member to the sheet;

a sheet discharge port through which the sheet is discharged out of the main casing; and a conveying path along which the sheet can be conveyed from the pick-up roller to the discharge port via the image transferring position, the conveying path comprising a turn between the pick-up roller and the image transferring position;

wherein the image transferring position is disposed at a position lower than an upper end of the turn in a vertical direction;

wherein the exposing unit includes a frame;

wherein the frame of the exposing unit includes an upper plate and a lower plate; and wherein a portion of the lower plate that is below the motor that is capable of rotating the polygonal mirror is inclined at an angle that is greater than an angle of the upper plate from a horizontal plane.

2. The image forming apparatus according to claim 1, wherein:

the process cartridge includes the photosensitive member and a transfer roller;

a peripheral surface of the transfer roller faces the photosensitive member; and the image transferring position is located between the photosensitive member and the transfer roller.

3. The image forming apparatus according to claim 1, wherein:

the frame of the exposing unit includes a front wall and a rear wall, and the rear wall has a greater height than a height of the front wall.

4. The image forming apparatus according to claim 3, wherein:

the exposing unit includes:

a laser diode capable of emitting the laser beam;

the polygonal mirror capable of reflecting the laser beam emitted by the laser diode;

a first mirror capable of reflecting the laser beam reflected by the polygonal mirror; and a second mirror capable of reflecting the laser beam reflected by the first mirror;

the first mirror is located closer to the front wall than to the rear wall; and the second mirror, the polygonal mirror and the motor are located closer to the rear wall than to the front wall.

5. The image forming apparatus according to claim 1, wherein, when the process cartridge is installed, the developer accommodating portion is disposed inside of an area between the image transferring position and the pick-up roller.

6. The image forming apparatus according to claim 1, further comprising:

a registration roller for correcting skew of the sheet, the registration roller being located on the conveying path between the pick-up roller and the image transferring position;

wherein, when installed, the process cartridge is located on the removal path closer to the image transferring position than to a position directly above the registration roller.

7. The image forming apparatus according to claim 1, wherein the exposing unit is located on the removal path at a position closer to the image transferring position than to a position directly above the pick-up roller.

8. The image forming apparatus according to claim 1, wherein:

a heat roller, a discharge roller and a guide are provided along the conveying path;

the heat roller is capable of heating the developer after the developer is transferred onto the sheet;

the discharge roller is capable of discharging the sheet from the image forming apparatus through the discharge port, the discharge roller being located near the discharge port;

the guide is capable of guiding the sheet along the conveying path; and the length of the conveying path between the heat roller and the discharge roller is shorter in length than a minimum length of the sheet in a direction along which the sheet is fed.

9. The image forming apparatus according to claim 8, wherein:

the guide includes a first curved portion and a second curved portion;

the first curved portion and the second curved portion are capable of turning the sheet after the sheet has passed the heat roller;

a first curvature of the first curved portion is greater than a second curvature of the second curved portion; and the second curved portion is closer to the heat roller than the first curved portion.

10. The image forming apparatus according to claim 1, the exposing unit further comprises an optical deflector and an optical member, wherein the optical member is disposed under the optical deflector.

11. The image forming apparatus according to claim 1, further comprising:

a discharge tray configured to stack the sheet after being discharged through the sheet discharge port; and a fixing unit that is capable of heating the developer after the developer is transferred onto the sheet, wherein the discharge tray includes a bottom surface, and wherein a lowest end of the bottom surface is lower than an upper surface of the fixing unit.

* * * * *